United States Patent [19]

Bayle Laboure et al.

[11] 4,259,839

[45] Apr. 7, 1981

[54] FLAME HOLDER DEVICES FOR COMBUSTION CHAMBERS OF TURBOJET ENGINE AFTERBURNER TUBES

[75] Inventors: Gerard J. P. Bayle Laboure, Paris; Buisson, Marc F. B., Le Mee sur Seine; Roger A. J. Vandenbroucke, Antony, all of France

[73] Assignee: Societe Nationale D'Etude et de Construction de Moteurs D'Aviation, Paris, France

[21] Appl. No.: 49,138

[22] Filed: Jun. 18, 1979

[30] Foreign Application Priority Data

Jun. 22, 1978 [FR] France ..... 78 18714

[51] Int. Cl.[3] ..... F02K 3/10

[52] U.S. Cl. ..... 60/261

[58] Field of Search ..... 60/261, 749

[56] References Cited

U.S. PATENT DOCUMENTS

| | | | |
|---|---|---|---|
| 2,799,991 | 7/1957 | Conrad | 60/261 |
| 2,935,847 | 5/1960 | Markowski | 60/261 |
| 3,096,261 | 10/1962 | Krabacher et al. | 60/261 |
| 3,269,116 | 8/1966 | Frasca et al. | 60/261 |
| 3,485,045 | 12/1969 | Riecke | 60/749 |
| 3,931,707 | 1/1976 | Vdoviak | 60/261 |

*Primary Examiner*—Robert E. Garrett

*Attorney, Agent, or Firm*—Bacon & Thomas

[57] ABSTRACT

A flame holder device of the type having a flame holder ring with a continuous cross section of revolution in the shape of a U or V, and a plurality of flame holder arms having a continuous cross section in the shape of a U or V and radiating from one of the flanks of the ring. According to the invention, each arm is attached to the ring by means of gussets which provide for a slight spacing of the arm from the ring in order to prevent local overheating of the ring due to the recirculation of combustion gases.

5 Claims, 6 Drawing Figures

FLAME HOLDER DEVICES FOR COMBUSTION CHAMBERS OF TURBOJET ENGINE AFTERBURNER TUBES

BACKGROUND OF THE INVENTION

The invention concerns flame holder devices for combustion chambers traversed by a flow of combustible gases. It concerns more particularly a flame holder device of the type used in the combustion chambers of aircraft turbojet engines and specifically in the after burner tubes of afterburning turbojet engines equipped with a reheating system.

It is known to equip the afterburning turbojet engines of commercial aircraft with a partial reheating system operating in the afterburner tube, either by increasing the rate of flow of the bank of injectors of the tube, or by the activation of supplementary injectors in order to compensate for an insufficiency of thrust due to the failure of an engine during takeoff by means of an instantaneous increase in the rate of reheating of the intact engines.

The afterburner tube of each engine is normally equipped with a flame holder ring arranged downstream from fuel injectors. In anticipation of the modification of the normal operating mode as the result of the intervention of the partial reheating system, it is known to increase the useful surface of the flame holder ring by means of flame holder arms secured to the ring and arranged so as to radiate from said ring. The following devices are known:

(a) to render the flame holder ring optimally effective, its cross section is advantageously of a U or V shape, with the sides joined by an arch with each spine oriented in the downstream direction of flow, (b) similarly, the transverse cross section of each flame holder arm is also in the shape of a U or V, with their sides joined by an arch facing with its spine in the downstream of flow, (c) in order to prevent the overheating of the wall of the tube due to the proximity of the end of the arms fastened to the external flank of the ring (i.e. the side facing the wall), it is preferred that at least the diameter of the ring should not be very much smaller than that of the tube and to secure the arms to the internal side of the ring, from where they radiate in the direction of the axis of the tube.

Without it being necessary to resort to the latter arrangement, it may be stated that it further presents the advantage that it generates at the outlet of the blast pipe of the tube a core of hot gas extending downstream from the outlet and wherein combustion may continue; this contributes to a decrease in the emission of unburned matter.

Whether the arms are fastened to the inner or the outer flank of the ring, it is customary to secure them by means of welding and to arrange the arms so that the weld will have the greatest length possible for the obvious reason of obtaining maximum mechanical strength and rigidity of the ring and arm assembly.

SUMMARY OF THE INVENTION

The present inventors have discovered that this conventional arrangement causes, for reasons to be explained, overheating and burning of the ring thus affecting the service life of the flame holder device. In other words, the remedy adopted has proved to be counterproductive. The object of the present invention is not merely to prevent overheating in the zones of junction of the arms to the ring, but also to limit the heating of the arms. According to the invention, each arm is arranged relative to the ring so that the spine of the arch of said arm extends from the ring of which it is an integral part appreciably downstream from the arch of the ring. Thus, as will be shown hereinbelow, this arrangement affords a reduction in local heating.

It is obviously advantageous, in order to reduce said overheating as much as possible, to place the initial section of each arm as far downstream as possible, the apex of the arch of said initial section then being appreciably closer to the downstream edge of the side of the ring than to the attachment of the side to the arch of the ring. But, the weld section then may become inadequate. The invention provides for the fastening of each arm to the ring by means of at least one gusset welded on the one hand to a portion of the generatrix of the ring, and on the other to the vicinity of the spine of the arch of the arm. The weld seams joining the gusset to the ring and to the arm may be made long enough so that it is possible to eliminate the weld securing the arm to the ring. It is then advantageous to provide an interval between the initial section of the arm and the side of the ring, so that the flow circulating in said interval favors the cooling of said initial section and the downstream part of said side. It is preferable to arrange the gussets in planes of orientation which pass through the axis of the tube so that their presence does not interfere with the flow. Advantageously finally, according to the invention:

the cross section of each arm evolves so that the dihedron constituted by the sides becomes more open as the section approaches the ring. In this manner, the drag on each arm is reduced appreciably and the center of thrust located in the vicinity of the ring;

the end of each arm opposed to the remote end is closed by a plate which facilitates its cooling by means of convective and radiative effects and all of the plates of the plurality of arms are oriented so that they define a conical surface with its apex facing upstream of the ring, in such manner that the incidence of the plates in relation to the flow eliminates separations harmful to the efficiency of cooling.

DESCRIPTION OF THE PREFERRED EMBODIMENTS

Figure 1:
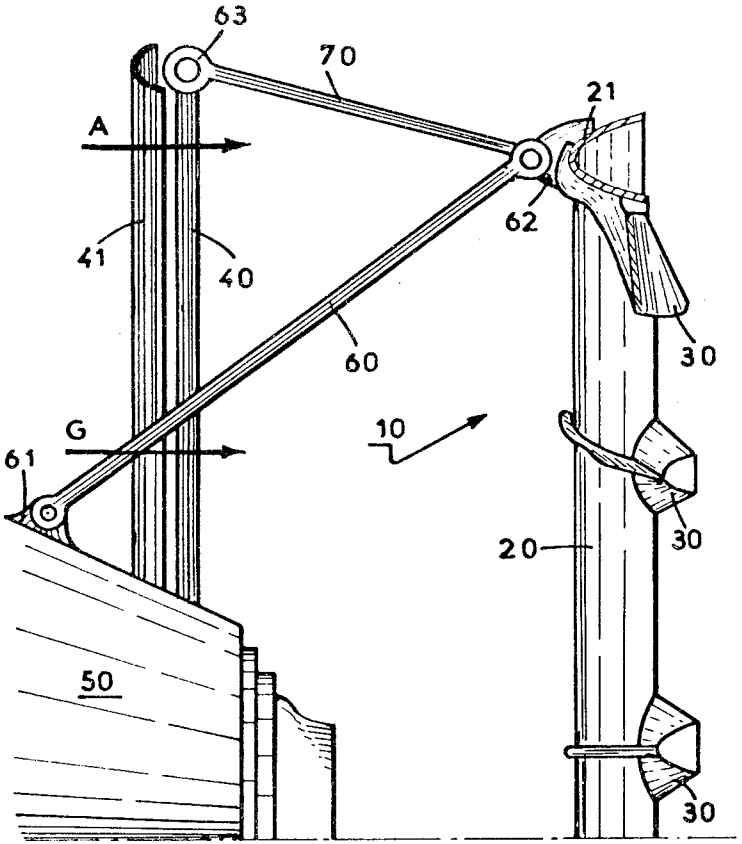
FIG. 1 is an axial cross sectional view of a part of an afterburner tube equipped with a flame holder device according to the invention.

FIG. 1 shall be considered first; it shows the inside of the afterburner tube (its wall not shown) of a turbojet engine containing a reheating system. The known arrangements of the system will be described first. The flame holder ring 20 of the flame holder device 10 has a continuous section in the shape of a U or V at the arch 21. It is arranged so that the spine of the arch is oriented in the upstream direction and so that the edges of the branches of the U or V are oriented in the downstream direction. The ring 20 supports a plurality of flame holder arms 30 beginning at the inner flank of the ring, i.e. the flank facing the axis of the tube, and extending toward said axis. An annular injector 40, supplied by tubing not shown, is placed around the end 50 of the central body of the turbojet engine, upstream from the flame holder device 10. It delivers fuel in counter-current by means of injector orifices, not shown, toward an annular anvil 41 with a cross section in the shape of a gutter. The ring 20 is supported by the end 50 of the central body by means of small, oblique connecting rods such as 60, each of them being articulated on the one hand on the end 50 of the body by means of a bracket 61 welded to said end, and on the other hand on the arch 21 of the ring 20 by means of a bracket 62 welded to the arch. The injector 40 is supported by the ring 20 with the aid of oblique connecting rods such as 70, each of them being articulated on the one hand on the arch 20 by means of the bracket 62, and on the other hand on the injector 40 by means of an annular strap 63 which embraces said injector ring. The anvil 41 is secured to the injector ring 40 by gussets not shown.

The injector ring 40 and the gutter 41 cooperate in injecting into the tube an annular sheet of fuel, which is highly homogeneous. The mounting of the ring 20 on the end of the body 50 by means of the articulated connecting rods 60 and of the injector ring 40 on the ring 20 by means of the articulated connecting rods 70 represent a composite isostatic suspension which keeps the ring and the injector centered on the axis of the tube without applying stresses to them, in spite of the large temperature variations to which these elements are exposed.

In the particular case of a dual flow engine, the stream of gas flowing through the tube consists in a first approximation of two concentric annular flows. One of these, indicated by the arrow G, surrounds the end 50 of the central body, it consists of the flow of gas supplied by the turbine, not shown in the figure; the other, indicated by the arrow A, surrounds the flow G; it is confined by the wall, not shown, of the afterburner tube. It consists of the secondary air admitted into the tube, wherein it mixes with the fuel supplied by the injector ring 40 and distributed by the anvil 41.

Figure 6:
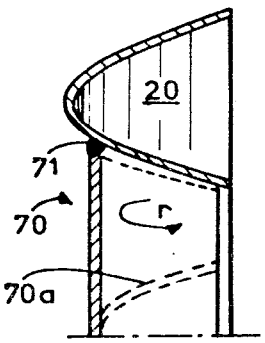
FIG. 6 is a similar sectional view of a portion of a flame holder device of the prior art.

In the normal mode of operation, the flame holder ring 20 suffices for the local reduction of the velocity of the flow A and to generate an annular zone of recirculation in order to maintain the flame in position. The swelling of the recirculation zone downstream from the flame holder arms creates highly stable combustion zones which guide the flame in the regions of the ring 20 not equipped with arms. Due to this effect, it is possible to increase the richness of the fuel mixture, either by means of a supplemental row of injectors, or, as is the case in the system illustrated in FIG. 1, by increasing the rate of flow in the injector ring 40. Thus, as indicated hereinabove, the invention consists of the configuration of the arms 30 and the mode of their fastening to the ring 20. To appreciate the advantage of the invention, FIG. 6 should be considered; it shows a conventional flame holder ring such as 20, equipped with flame holder arms 70 of known type in the form of gutters, i.e., as shown by the flanged semi-section 70*a*, with a cross section in the shape of a U or V and with their sides joined by an arch, the spine thereof facing in the upstream direction. One of the ends of the ends of the arm 70 is fastened over its entire cross section to one of the flanks of the ring 20 and to at least a part of the arch of said ring by means of a weld seam 71. Experience shows that arms such as 70 play their role as supplementary flame holders effectively. In contrast, their adjunction considerably reduces the service life of the ring 20. In particular, the appearance of cracks in the welds 71 and burns in the ring within the zones outlined by said welds. The inventors discovered that these incidents are due to overheating caused by the recirculation of hot gases in the cavity of arms adjacent to the ring, said recirculation being indicated in FIG. 6 by the arrow "r". While the zones of the ring between the arms are cooled normally by the fuel mixture (A flow of FIG. 1), the zones comprising said cavity are heated constantly by the combustion gases. The resulting differential thermal stresses are even more dangerous, because the overheating degrades the local structure of the metal of the ring.

FIGS. 2, 3, 4 and 5 are now considered; they all relate to an embodiment of a flame holder device which employs all of the solutions of the invention to eliminate the abovementioned harmful phenomena. As shown, particularly in FIG. 5, each flame holder arm 30 (see FIG. 1) is placed as far downstream as possible in order to further reduce the surface of the portion of the ring exposed to overheating. The spine 31 of the arch of the arm thus originates appreciably downstream from the arch 22 of the ring and even, if possible, closer to the trailing edge of the flank 23 of the ring than to the attachment of this flank to the arch 22. Furthermore, the trailing edge 32 of the flanks of the arm 30 have such a configuration that they originate in the vicinity of the rim 24 of the flank 23, which eliminates all overheating of the arm in a zone protruding downstream from the rim 24. This configuration may be obtained by tapering the rims 32. It may also be attained by providing the arm 30 with a variable cross section which evolves in a manner so that the dihedron formed by its flanks 34 (see FIGS. 3 and 4, which are sections of the arm in the x and y planes of FIG. 2) becomes more open as the section approaches the ring. This second embodiment presents the further advantage of placing the center of the thrust of the gases on each arm in the vicinity of the ring, thus reducing the drag of the ends of the arms remote from the ring.

Figure 5:
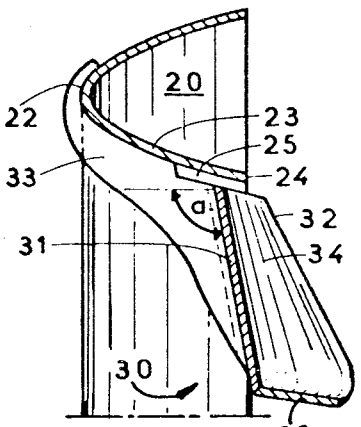
FIG. 5 is a sectional view taken on the axial plane of FIG. 2.

All of these arrangements may be employed together with the fastening by welding of the arms to the ring, provided, however, that the mechanical strength of the assembly remains adequate. The optimum solution to eliminate overheating consists in placing each arm 30 as far downstream as possible from the ring 20 so that, as shown in FIG. 5, the spine 31 of the arm originates at the flank 23 of the ring in the vicinity of the passage rim 24. The rigidity of the weld assembly is then effected. The invention therefore proposes to reinforce the joint between the arm and the ring by means of at least one gusset 33 welded on the one hand to a portion of the generatrix of the ring upstream of the arm, and on the other hand in the vicinity of the arch 31 of the arm; the gusset 33 is consequently oriented in an axial plane of the tube and in practice does not interfere with the flow. The strength of the attachment of the arm to the ring thus increases with the degree to which the welds extend over the arch of the arm and over a length of the generatrix of the ring. The placing of the two gussets 33 (FIGS. 3, 4) confers greater rigidity on the assembly while reducing the widths of the gussets and of the welds. The use of one or two gussets finally permits the elimination of the welding of the arm to the ring and to provide an interval 25 (FIG. 5) between them, thus allowing the passage of the combustible mixture to facilitate cooling.

FIGS.. 2, 4 and 5 also show a plate 35 closing the end of the arm 30 opposite to the ring 20. It acts by means of radiative and convective effects to facilitate the cooling of the arm. It is preferable, as shown in FIG. 5, that the plate 35 be inclined in the downstream direction of the axis of the tube. In other words, the plurality of plates 35 is arranged on a conical surface with its apex downstream from the ring. This arrangement prevents the separation of the flow, which would appreciably reduce the effectiveness of the plates.

Figure 2:
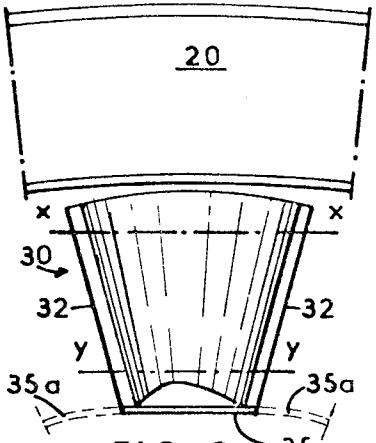
FIG. 2 is a front elevation, on a larger scale, of a portion of the flame holder device shown in FIG. 1.
Figure 3:
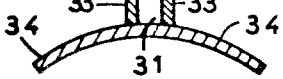
FIG. 3 is a sectional view taken on the line x—x of FIG. 2.
Figure 4:
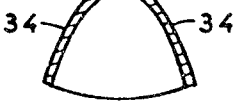
FIG. 4 is a sectional view taken on the line y—y of FIG. 2.

FIG. 2 shows, by the extensions 35*a* represented by broken lines, that it is possible to elongate each plate 35 on either side of its arm 30. At the limit, the plates 35 may be parts of a cooling ring concentric to the flame holder ring 20, but they may also constitute one of the flanks of a second flame holder ring concentric with the ring 20. The arms may be secured to this second flame holder ring advantageously by means of gussets in a manner similar to their attachment to the ring 20.

As also seen in FIGS. 1 and 5, the arms 30 are inclined with respect to the transverse section of the tube so that they converge at a point of the axis downstream from the ring 20. In other words, the angle formed by the general direction of the flow A and by the spine of the arch of each arm is an obtuse angle. This arrangement favors the formation of the core of hot gas mentioned hereinabove.

Certain numerical indications will now be given. If there are two gussets 33 per arm 30 (FIGS. 3 and 4), they must be sufficiently close to each other so that no recirculation will occur in the cavity outlined by them and sufficiently spaced to prevent the interaction of the welds produced beginning at the face of each gusset opposed to the other gusset. The optimum space between the two gussets is of the order of 1 to 2 mm. Concerning the space 25 provided between the ring 20 and each arm 30 (FIG. 5), it must be large enough to allow the passage of an adequate flow of cooling gas, without, however, exceeding a limit beyond which the flow of gas may extinguish the flame downstream from the arms. Experiments conducted by the inventors have shown that the width should in general be between 0.5 mm and 4 mm and that a width of 1 to 2 mm is suitable in most cases. Operating tests performed by the inventors on a flame holder device according to the invention but without the closing plates 35, showed that the temperatures attained in the different zones of the device are as follows:

gussets 33, approximately 850° C.;

the outside (external wall) of the gutter shaped section of the ring 20, approximately 850° C., including the region outlining the space 25;

the outside (external wall) of the section in the shape of a gutter of the arms 30: approximately 850° C. at the end close to the ring 20. 1 050° to 1050° C. at the opposite end, 900° to 1 050° C. in the intermediate regions;

the inside of the gutter shaped section of the arms 30: approximately 950° C. at the end close to the ring 20. 1050° to 1 150° C. at the opposite end, 1 000° to 1050° C. in the intermediate regions.

It is seen that the presence of the space 25 provides effective cooling of the facing regions of the ring and the arms. Concerning the ends of the arms opposed to these regions, the juncture of the plates 35 evidently reduces their temperature. The device of the invention may be used with countercurrent injectors as in the example presented in the instant description, as well as with equicurrent injectors. The distribution of the arms is obviously less critical in the first case than in the second.

We claim:

1. Flame holder device for a combustion chamber, in particular for the afterburner tube of a turbojet of the type comprising a flame holder ring of revolution with a constant cross section in the form of a U or a V, the flanks of said ring being joined by means of an arc, the spine of which is oriented toward the upstream of the flow of gas passing through the chamber, a plurality of flame holder arms radiating from one of the flanks of the ring, each arm having a transverse section in the form of a U or a V, the flanks of which are joined together by an arc, the spine of which is oriented upstream, the spine of the arc of each arm being located closer to the downstream or outlet edge of said flank, than to the attachment of said flank to the arc of the ring, characterized in that each arm is secured to the ring by means of a bracket essentially oriented in an axial plane of the tube and welded on one side to a portion of the generatrix of the ring and on the other, to the vicinity of the spine of the arm.

2. Flame holder device according to claim 1, characterized in that each arm is secured to the ring by means of two substantially parallel brackets.

3. Flame holder device according to one of claim 1 or 2, characterized in that a space is provided between the adjacent end of each arm and said flank of the ring.

4. Flame holder device according to claim 3, characterized in that the width of the space is between 0.5 mm and 4 mm.

5. Flame holder device according to claim 1, characterized in that the section of each arm is such that the dihedron defined by the flanks becomes greater toward the ring.

* * * * *